United States Patent [19]

Schiffer

[11] 4,275,575

[45] Jun. 30, 1981

[54] DEVICE FOR WET PRE-TREATMENT OF WEB-SHAPED TEXTILE MATERIAL IN A DAMPER

[75] Inventor: Günter Schiffer, Krefeld, Fed. Rep. of Germany

[73] Assignee: Kleinewefers GmbH, Krefeld, Fed. Rep. of Germany

[21] Appl. No.: 29,079

[22] Filed: Apr. 11, 1979

Related U.S. Application Data

[62] Division of Ser. No. 859,687, Dec. 12, 1977, abandoned.

[30] Foreign Application Priority Data

Dec. 10, 1976 [DE] Fed. Rep. of Germany ..... 2655955

[51] Int. Cl.[3] ..... D06B 3/10; D06B 23/18

[52] U.S. Cl. ..... 68/5 E

[58] Field of Search ..... 68/5 D, 5 E, 62, 177, 68/178, 181 R; 8/149.1

[56] References Cited

U.S. PATENT DOCUMENTS

| | | | |
|---|---|---|---|
| 761,107 | 5/1904 | Rovira | 68/5 E |
| 2,431,372 | 11/1947 | Cook et al. | 68/5 D X |
| 2,443,990 | 6/1948 | O'Keeffe | 68/5 E |
| 2,777,312 | 1/1957 | Thomas et al. | 68/5 D |
| 3,730,678 | 5/1973 | Wedler et al. | 8/149.1 |

FOREIGN PATENT DOCUMENTS

| | | | |
|---|---|---|---|
| 2605292 | 8/1977 | Fed. Rep. of Germany | 68/5 E |
| 411917 | 10/1974 | U.S.S.R. | 68/5 D |

*Primary Examiner*—Philip R. Coe

*Attorney, Agent, or Firm*—Becker & Becker, Inc.

[57] ABSTRACT

A device for subjecting web-shaped textile material to a wet pre-treatment in a damper while passing the textile material along a zig-zag path over rollers alternatingly pertaining to one of two substantially parallel vertical rows of rollers, and through a take off or plaiting device. The dry or squeeze-wet textile material is passed through a vacuum and directly subsequently thereto through a treatment bath. Thereupon, the thus treated textile material is withdrawn from the treatment bath and is passed into a damper where it is plaited for from 8 to 20 minutes (abgetafelt).

10 Claims, 4 Drawing Figures

DEVICE FOR WET PRE-TREATMENT OF WEB-SHAPED TEXTILE MATERIAL IN A DAMPER

Figure 1:
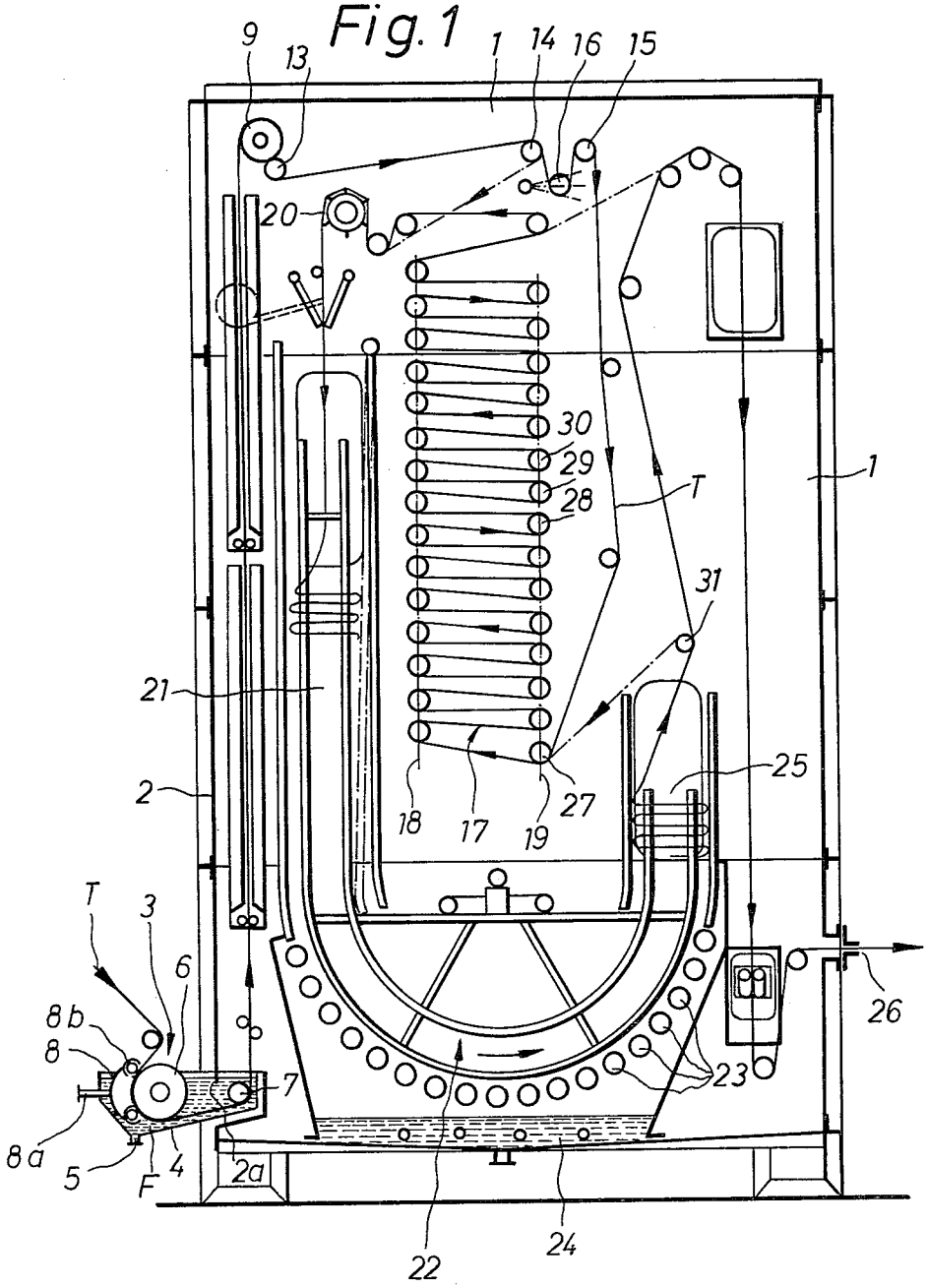

This is a divisional of co-pending parent application Ser. No. 859,687—Schiffer filed Dec. 12, 1977, (Monday), now abandoned.

The present invention relates to a device for wet pretreating of web-shaped textile material in a damper while passing the textile material in a zig-zag course over two vertical rows of rollers and through a plaiting or folding device. The finishing process for web-shaped textile material, for instance the dyeing and printing is preceded by a pretreatment of the textile material with chemicals such as NaOH, NaClO, $H_2O_2$, whereby for instance the bleaching, the absorbing capability, or the freedom from husks and impurities of the web-shaped textile material is influenced. The heretofore known wet pre-treatment can be divided into three groups, namely a short period treatment up to three minutes duration, in most instances under an overpressure, a medium time treatment of from about 5 to 15 minutes duration, and a long time period of more than 20 minutes up to several hours duration. The quantity of chemicals utilized is generally inversely proportional to the length of the treatment time, which means that the longer the reaction time is selected, the less will be the necessary quantity of chemicals and auxiliary means and concentration.

In connection with the wet pretreatment of web-shaped textile material there is further to be taken into consideration that with sensitive textile material a formation of folds, especially in alkaline processes such as the boiling of the soda lye, has a disadvantageous effect. Due to such formation of folds, the textile material undergoes a nonuniform treatment which during the succeeding finishing process causes the formation of stripes transverse to the web-shaped textile material. Especially with the known short time and medium time treatments the said drawback makes itself particularly noticeable.

In order to take the above drawbacks into consideration, a device has been used according to which the textile material is passed over two horizontal rows of rollers vertically along a zigzag course and is subsequently passed over a take-off or unwinding device. In the horizontal row of rollers, a sufficiently long treatment or acting time of the treatment liquor upon the textile material is to be assured. This known device, however, does not permit a great output because the textile material has to be passed over a relatively long period of the rows of rollers whereupon it has to be stored for a longer period of time of over 20 minutes in the take-off device. In particular, during the boiling and scalding process for sensitive fabrics, such as gabardine, a disadvantageous formation of folds in the take-off device can be avoided only when the textile material remains in the rows of rollers for a relatively long time. If this is not done, the textile material shows swelling flaws in the textile fiber which entails drawbacks during the later finishing process.

It is here where the invention starts. The problem underlying the present invention consists in providing a device by means of which a greater output can be realized without swelling flaws will occur during a short or medium time treatment.

It is another object of this invention to provide a device of the above mentioned type which will permit possibilities of varying the pretreatment of web-shaped textile material.

These and other objects and advantages of the invention will appear more clearly from the following specification in connection with the accompanying drawings, in which:

FIG. 1 represents a vertical section through a device according to the invention.

Figure 2:
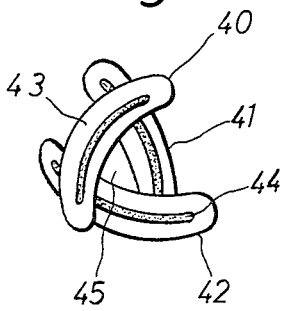
Figure 3:
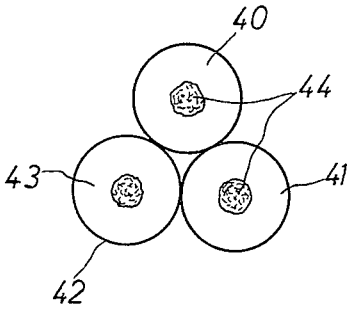
Figure 4:
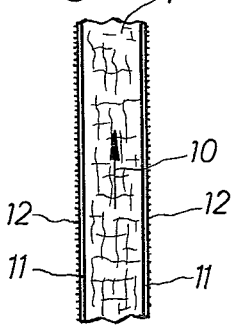

FIGS. 2, 3 and 4 respectively illustrate conditions of the textile material and the fibers thereof during the individual method steps when the textile material is being treated in the device of FIG. 1.

According to the present invention, it is provided that the dry or squeeze-moist textile material is passed through a vacuum and directly subsequently thereto through a treatment bath whereupon the textile material is conveyed from the bath directly into a damper where it is plaited during a period of from 8 to 20 minutes.

U.S. Pat. No. 3,848,439-Lopata issued Nov. 19, 1974 belonging to the assignee of the present invention discloses a device especially for impregnating and dyeing wide webs of textile material in a continuous manner. According to this device, a vacuum device is employed which comprises a hood that extends approximately over the length of a roller and is provided with a rim-like support. The thus formed vacuum space of the hood has its lower end immerged in a liquor container.

The device according to the invention takes advantage of the known vacuum device in order to effect a pretreatment of the textile material in such a way that the fibers of the textile material swell in the treatment bath or on their way to the plaiting device, which means that the fibers obtain their full cross section prior to reaching this plaiting or holding device. As a result thereof, on one hand a considerable reduction in the treatment time is obtained, and the drawbacks of the fold formation on the other hand are eliminated.

According to the further development of the device according to the invention, the web-shaped textile material prior to the plaiting is passed in the damper over rollers for a period of from 10 to 120 seconds. The passing over rollers can be entirely or partially omitted if already a complete swelling of the fibers of the textile material is obtained ahead of the plaiting device.

Furthermore, during the passing of the textile material along a zigzag course about the rollers, the textile material may be provided with additional treatment liquor in order to fully carryout the swelling process of the fiber prior to the textile material being passed into the plaiting device where the textile material is likewise subjected to steam or vapor during the entire process.

According to a modification according to the invention, the textile material may following the plaiting operation be washed out in a washing device of the damper with a clean liquor. To this end, the column of rollers in the damper is used.

The device for carrying out the present invention provides a liquor container known per se with a vacuum device which in the manner of a water lock partially extends into the damper while the feeding of the textile material is arranged outside the damper and the withdrawal of textile material is arranged within the damper. The vacuum liquor bath thus serves at the same time for sealing the damper when introducing the textile material and for impregnating the web.

For plaiting the textile material, preferably a wide U-shaped vessel, open width J-box or similar U-shaped container may be used. Between the legs of said U-shaped container and a damper wall the textile material is passed upwardly out of the liquor container. The right hand or approximately vertical guiding of the textile material after it has left the liquor container has the advantage that the possible steam of the damper chamber which condenses upon the textile material will flow downwardly on the fully impregnated textile material and will already carry along a film of liquor upwardly out of the liquor container. During the condensation of the steam, the condensation heat is transmitted to the textile material and the steam which otherwise during a condensation would bring about a dilution of the liquor on or in the textile web will pass on the outside of the textile web, vertically downwardly.

For selectively guiding the textile material within the container, which means whether the textile material is after leaving the liquor container passed into the U-shaped container and thereupon into the column of rollers, or whether the textile material is first passed through the column of rollers, and then through the U-shaped container, there is selected a deviating roller arrangement in the upper and lower section of the damper by means of which arrangement there will be possible a direct selective feeding of the textile material to or withdrawal of the textile material from the U-shaped container or the column of rollers.

Referring now to the drawings in detail, the device for carrying out treating according to the invention comprises a damper 1 which at the lower end of one of its side walls 2 comprises a vacuum dye liquor treating device 3, for instance of the type described in the above mentioned U.S. Pat. No. 3,848,439. This device comprises a container 4 with outlet 5 as well as rollers 6, 7 arranged within said container. The vacuum cap 8 which is connected to the vacuum line 8*a* has its sealing strip 8*b* resting against the surface of roller 6.

While the bottom and the side walls of the container 4 are surrounded by the lower end of wall 2, the section 2*a* of the wall 2 forms an apron in the direction of the width of the container 4 which apron immerses sealingly into the liquor F of the container 4. The section 2*a* is in a corresponding manner tightly connected to the inner side of the two container walls so that in toto the container 4 with its content as well as with the correspondingly designed section of wall 2 forms a water lock for the damper 1.

The textile material T moves in the direction indicated by an arrow over roller 6 into the liquor F, e.g. a peroxide or solution of caustic soda, after the textile material has passed through the vacuum cap 8. In the vacuum cap 8, the interstices between the individual fibers are evacuated so that after immersing the textile material into the liquor F, said interstices are filled with liquor, and the fibers are substantially on all sides wetted by the liquor.

The textile material T after leaving the roller 7 moves vertically upwardly through the damper 1 to a deviating or reversing roller 9. While so moving, the water vapor deposits on the textile material T. As will be evident from FIG. 4, the textile material rises in the direction of the arrow 10 and on its outer sides takes along a liquor layer 11 from the container 4. This liquor layer is reduced and diluted with increasing height. The condensate layer is reduced and diluted with increasing height. The condensate 12 deposits on said liquor layer 11 and in the same way as the liquor layer 11 can float downwardly on the outside of the material without diluting the liquor absorbed by the textile material.

After the textile material has passed about the rollers 13,14, 15 and about a compensating roller 16 provided between the rollers 14 and 15, the textile material enters the lower section of a vertical roller column 17 comprising two parallel rows of rollers 18, 19 spaced from each other. After leaving this vertical roller column, the textile material passes over intermediate rollers and a folding device 20 in the legs 21 of a U-shaped container 22. The lower open section of said container 22 comprises a row of rollers 23 through which steam from a vat 24 is conveyed to the textile material, said vat containing water and chemicals which dripped off the web of textile material. The textile material after leaving the second shorter leg 25 is discharged from the damper at 26. While the textile material passes through the roller column 17, the textile material may selectively be acted upon by a liquor which is weaker or stronger or the same as the liquor F of the container 4. Instead of being passed about the lower most roller 27 of the column 17, the textile material may also selectively be passed about each of the rollers 28, 29, 30 etc., thereabove. In this way, the length of the column can be shortened at will without thereby reducing the length of the said U-shaped container and thus the time period for the plaiting. Thus, there exists the possibility to vary the length of the time interval preceding the plaiting operation and also the action upon the textile material.

According to a modification of the device according to the invention, the textile material, instead of being guided along a straight line, can also be passed from roller 14 along the dotdash line to the folding devices 20 and subsequently through the container 22 whereupon it is deviated by roller 31 and conveyed to the roller column 17. Here, the textile material may again be washed for a desired treatment time in the column with pure liquor or with water so that in the damper 1 a selective complete pretreatment of the textile material can be effected.

FIGS. 2 and 3 illustrate the effect upon the fibers of the textile material T. In their starting position prior to entering the liquor F of the container 4, the fibers 40, 41, 42 of FIG. 2 have a curved banana-shaped form in which the peeling 43 uniformly surrounds the lumen of fiber core 44. When the textile material enters the vacuum dye liquor treating device, air or liquid fills the interstices 45 between the fibers. Due to the action of the vacuum in the hood 8, this space will be evacuated so that liquor can pass from the container 4 into said interstices whereby the fiber can be acted upon not only at its outside but also at its interstices 45 by the said liquor. This brings about that the fiber will swell and evantually have a cross section illustrated in FIG. 3. Here the lumen 44 is cross sectionwise deformed circularly, and the peeling 43 in the form of a cylinder surrounds the lumen uniformly. In such a condition of the fibers, the formation of folds in the container 22 does not cause any drawbacks provided that not too great a load is exerted upon the fold for any longer period (ironing effect). The devices preceding the U-shaped container 22, and the steps to be taken prior to the unwinding operation depend on the extent to which during the movement from the vacuum liquor treating device 3 to the container 22 a complete swelling of the fibers has taken place. If this is the case already at the roller 14, the textile material can via plaiting device 20 be passed directly into the container 22. If this is not the case, a short time post-treatment in the column 17 is to be effected. This post-treatment is, however, in contrast to the heretofore known wet treating process only very short because the swelling of the fibers which already started in the device 3 has greatly progressed when the roller 14 has been reached.

It is, of course, to be understood that the present invention is by no means limited to the specific showing in the drawings but also comprises any modification within the scope of the appended claims.

What I claim is:

1. A device for subjecting web-shaped textile material to a wet pre-treatment, which includes in combination: a damper having means forming a wall section therewith, a container including means forming a wall therewith and having a textile treating liquor therein, a vacuum device from which the textile material passes directly into said container, said container having a portion extending into said damper in the manner of a waterlock, at least one vertical roller column including two parallel rows of rollers in said damper, means for plaiting the textile material within said damper, means for selectively feeding textile material to either said means for plaiting or the vertical roller column within the damper, and textile material withdrawing means located inside said damper for withdrawing pre-treated textile material from said container and passing said withdrawn textile material fully saturated with treating liquor into said damper.

2. A device in combination according to claim 1, which includes a U-shaped container arranged within said damper as said means for plaiting said textile material, and conveying means arranged between said U-shaped container and said wall section of said damper for conveying textile material to be treated from said container section in upward direction in said damper.

3. A device in combination according to claim 2, in which said U-shaped container has two legs with said vertical roller column provided between said legs and extending in an upright direction within said damper, said two parallel rows of rollers comprising two upright roller columns arranged side by side in spaced relationship to each other for receiving and guiding in a zig-zag course the web of textile material to be treated.

4. A device in combination according to claim 3, which includes deviating roller means respectively arranged in the upper and lower region of said damper for selectively passing the textile material to be treated into and withdrawing it from said U-shaped container.

5. A device in combination according to claim 3, which includes deviating roller means respectively arranged in the upper and lower region of said damper for selectively passing the textile material to be treated into and withdrawing it from said roller column.

6. A device for wet pretreatment of web-shaped textile material, comprising, a damper, a container having a textile treating liquor therein, a vacuum device from which the textile material passes directly into said container, a vertical roller column within said damper and including two parallel rows of rollers, a U-shaped container means arranged within said damper for plaiting the textile material, and textile material feeding means for selectively feeding the textile material to said U-shaped container means or to successive rollers of said roller column.

7. A device according to claim 6, in which said container forms a waterlock, said textile material feeding means being located externally of said damper, and a textile material discharge means located inside said damper.

8. A device according to claim 6, in which said U-shaped container means has legs between which said vertical roller column is arranged.

9. A device according to claim 8, including a damper wall, said damper and one of said legs of said U-shaped container means defining an intermediate space in which the textile material is guided vertically upwardly out of said container.

10. A device according to claim 8, including a damper wall, said damper wall and one of said legs of said U-shaped container means defining an intermediate space in which the textile material is guided at an angle upwardly out of said container.

* * * * *